US011276383B2

(12) United States Patent
Barski et al.

(10) Patent No.: US 11,276,383 B2
(45) Date of Patent: Mar. 15, 2022

(54) ACOUSTIC INSULATOR FOR SMART SPEAKER DEVICES

(71) Applicants: Braunislaw Barski, Deerfield Beach, FL (US); Karen Vanessa McIntosh-Hill, Deerfield Beach, FL (US)

(72) Inventors: Braunislaw Barski, Deerfield Beach, FL (US); Karen Vanessa McIntosh-Hill, Deerfield Beach, FL (US)

(73) Assignee: Hive Security, LLC, Deerfield Beach, FL (US)

( * ) Notice: Subject to any disclaimer, the term of this patent is extended or adjusted under 35 U.S.C. 154(b) by 460 days.

(21) Appl. No.: 16/367,901

(22) Filed: Mar. 28, 2019

(65) Prior Publication Data

US 2020/0312291 A1 Oct. 1, 2020

(51) Int. Cl.

| | |
|---|---|
| ***G10K 11/162*** | (2006.01) |
| ***H04R 1/34*** | (2006.01) |
| ***H04R 1/02*** | (2006.01) |
| ***G10K 11/20*** | (2006.01) |

(52) U.S. Cl.

CPC ..... *G10K 11/162* (2013.01); *G10K 11/20* (2013.01); *H04R 1/025* (2013.01); *H04R 1/34* (2013.01)

(58) Field of Classification Search

CPC ..... G10K 11/162; G10K 11/20; H04R 1/025; H04R 1/34; H05K 5/24

USPC ..... 181/202

See application file for complete search history.

(56) References Cited

U.S. PATENT DOCUMENTS

| | | | | |
|---|---|---|---|---|
| 2,373,172 | A | 4/1945 | Darby | |
| 3,963,883 | A | 6/1976 | Kulka | |
| 4,883,144 | A | 11/1989 | Haushalter | |
| 7,080,816 | B1 * | 7/2006 | Vaccaro | F16M 11/18 248/530 |
| 8,184,820 | B2 * | 5/2012 | Abe | G10K 11/17857 381/71.4 |
| 8,189,849 | B2 * | 5/2012 | Waddell | H04R 1/02 381/388 |
| 8,203,850 | B2 | 6/2012 | Bouza, II et al. | |
| 8,408,356 | B2 | 4/2013 | Yamaguchi et al. | |
| 9,336,768 | B2 | 5/2016 | Soufan et al. | |

(Continued)

FOREIGN PATENT DOCUMENTS

EP 3273700 A1 * 1/2018 ..... G10K 11/161

*Primary Examiner* — Forrest M Phillips

(74) *Attorney, Agent, or Firm* — Mark P. Stone

(57) ABSTRACT

A housing for a smart speaker device, is formed, at least in part, from a sound absorbing material, a sound reflecting material, or both. The housing includes one or more doors which can be selectively opened or closed by an authorized person to permit the transmission of an externally generated voice signal to be received by the smart speaker device when the door is opened, and to prevent the receipt of any voice signal by the smart speaker device when the door is closed. The door can be controlled manually, or remotely by an external signal from a remote actuating device. The housing includes an internal electrical receptacle for electrically actuating the smart speaker device enclosed within the housing, and the internal electrical receptacle is coupled to a source of external electrical energy for powering the smart speaker device.

15 Claims, 1 Drawing Sheet

(56) References Cited

U.S. PATENT DOCUMENTS

| | | | | |
|---|---|---|---|---|
| 10,038,950 | B2 | 7/2018 | Avliav et al. | |
| 10,468,007 | B1 * | 11/2019 | Cunningham | G10K 11/16 |
| 10,677,477 | B2 * | 6/2020 | Gotou | F24F 1/12 |
| 2017/0345408 | A1 * | 11/2017 | Hong | H04R 25/50 |

* cited by examiner

ACOUSTIC INSULATOR FOR SMART SPEAKER DEVICES

BACKGROUND OF THE INVENTION

The present invention is generally directed to sound absorbing and/or sound reflecting insulators for smart speaker devices. More specifically, the present invention is directed to sound absorbing/sound reflecting housings or other storage compartments constructed to prevent unintentional activation of smart speaker devices enclosed therein.

Smart Speaker Devices, such as devices currently marketed under the designations ALEXA, SIRI, ECHO, and GOOGLE ASSISTANT, are generally placed in open areas of residences or businesses so as to be activated by a voice signal from an authorized user in close proximity to the device. These smart speaker devices do not have voice recognition software, and therefore are subject to inadvertent actuation or intentional actuation by unauthorized persons, thereby resulting in transmitting or providing unintended access to personal conversations, emails, and files by such unauthorized persons, and compromising the privacy and security of the owner of the smart speaker device.

The following United States patents are directed to devices provided for the purpose of reflecting or absorbing sound to improve the quality of voice transmission or to protect the privacy of voice communications:

U.S. Pat. No. 10,038,950 is directed to a case for a microphone with a sound reflector which improves the transmission of sound when the microphone is in operation;

U.S. Pat. No. 9,336,768 is directed to a temporary storage compartment for mobile devices at locations where sensitive conversations are being conducted. The compartment prevents audible signals from being received by the mobile device by generating acoustic signals to mask the audible signals;

U.S. Pat. No. 8,408,356 is directed to a storage box for electronic apparatus for reducing noise during the operation of the electronic apparatus housed therein;

U.S. Pat. No. 8,203,850 is directed to a compartment for housing an electronic device and having a noise generator to minimize signal emissions from the interior of the compartment to the exterior of the compartment. The noise generator prevents the device within the compartment from recording audio signals originating from the exterior of the compartment;

U.S. Pat. No. 4,883,144 is directed to a housing formed from a noise absorbing material for absorbing noise generated by an appliance operating within the housing;

U.S. Pat. No. 3,963,883 is directed to a soundproof enclosure for a telephone to prevent use of the telephone for surveillance purposes. The enclosure also includes sound generating means to interfere with any audio signals that might penetrate the enclosure; and U.S. Pat. No. 2,373,172 is directed to a muffler for components of a communications system which reduces external interfering sounds.

It is the primary object of the present invention to provide an enclosure for a smart speaker device which reduces or eliminates the possibility of unintended or unauthorized access to the smart speaker device housed within the enclosure to safeguard and protect the privacy and data of the owner or authorized user of the smart speaker device.

SUMMARY OF THE INVENTION

An enclosure, including a housing for a smart speaker device, is formed, at least in part, from a sound absorbing material, a sound reflecting material, or both. The housing includes closure elements such a door or doors which can be selectively opened or closed by an authorized person to permit the transmission of a voice signal to be received by the smart speaker device when the door(s) is opened, and to prevent the receipt of any voice signal by the smart speaker device when the door(s) is closed. The closure elements of the housing can be controlled manually, or remotely by a signal generated by a remote actuating device external of the housing. The housing includes an internal electrical receptacle for electrically actuating the smart speaker device enclosed therein, and means for coupling the internal electrical receptacle to an external source of electrical energy.

DESCRIPTION OF THE BEST MODES FOR CARRYING OUT THE INVENTION

Figure 1:
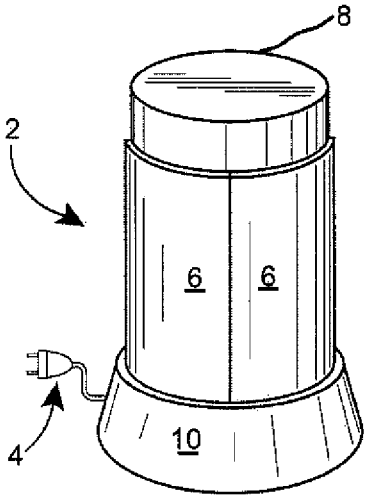
FIG. 1 illustrates a perspective view of the acoustic insulator device in which the doors are closed.

Referring FIG. 1 of the drawing, reference numeral 2 generally designates a housing for a smart speaker device enclosed therein, and reference numeral 4 illustrates a plug and electrical cord for providing electrical energy to the smart speaker device within the housing. The housing 2 includes two doors 6 shown in a closed position, a top section 8, and a bottom portion 10 which provides a stand for the housing. As will be discussed herein, the bottom stand 10 is preferably hollow and defines an internal compartment therein.

Figure 2A:
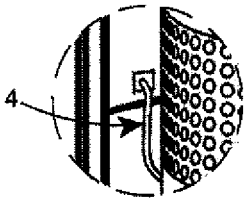
FIG. 2A is an isolated view of the device of FIG. 2 showing the connection of the smart speaker device to an external source of electrical energy.
Figure 2:
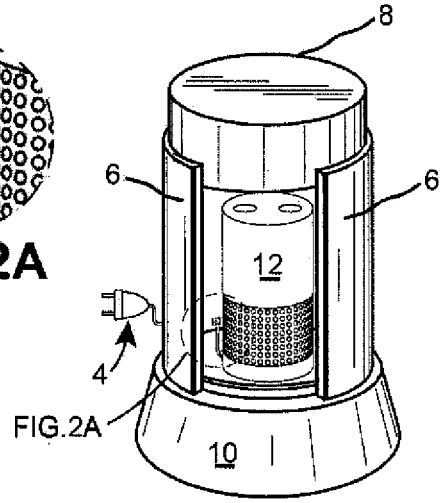
FIG. 2 illustrates the device of FIG. 1 in which the doors are open, showing the smart speaker device therein.
Figure 5:
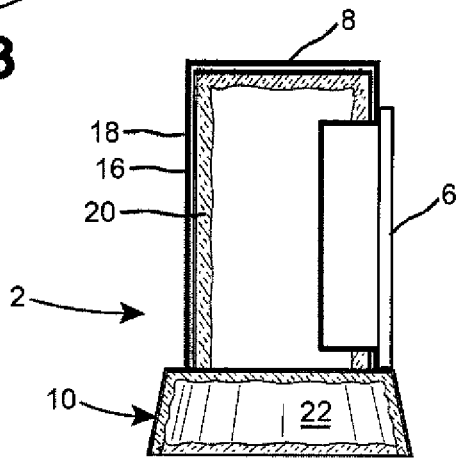
FIG. 5 is a sectional view of FIG. 4 taken along the directional arrows 5-5 of FIG. 4.

FIG. 2 of the drawing illustrates the device of FIG. 1 in which the doors 6 of the housing 2 are slid, either manually or remotely, into an opened position, exposing a smart speaker device 12 enclosed within the housing 2. With the doors 6 of the housing 2 opened, external voice signals will be received by the smart speaker device 12. As best seen in FIG. 5, the top section 8 is formed integrally with the housing 2, and provides a top guide for opening and closing the doors 6. an upturned bottom portion of the housing 2 provides a bottom guide for the doors 6.

Figure 3:
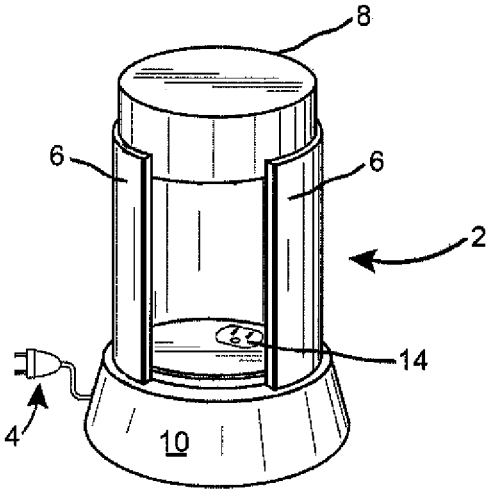
FIG. 3 illustrates the device of FIG. 2 in which the smart speaker device has been removed.

FIG. 2A illustrates that the electrical cord 4 passes through an opening in the wall of the housing to provide external electrical energy to the smart speaker device. The electrical cord 4 can be directly connected to the smart speaker device 12, or, as illustrated by FIG. 3, can be connected to an electrical receptacle 14 provided within the housing 2 to which the smart speaker device is removably connected when the smart speaker device is received within the housing 2.

Figure 4:
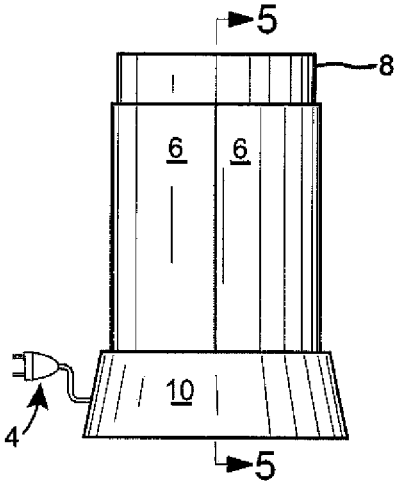
FIG. 4 illustrates a front elevational view of the device of FIG. 1.

FIG. 4 illustrates a front elevational view of the acoustic isolator device shown by FIG. 1, and FIG. 5 is a sectional view of the acoustic isolator device viewed along directional arrows 5-5 of FIG. 4. As best seen by FIG. 5, the sidewall 16 of the housing 2 and the doors 6 are formed from an outer lining of a sound reflecting material 18 and an inner lining of a sound absorbing material 20. Thus, when the doors 6 are closed and the smart speaker device is fully enclosed within the housing 2, any sound signals in the area of the housing will be reflected away from the housing by the outer sound reflecting layer 18. In the event that any of the sound signals do penetrate the sound reflecting layer 18 and the housing sidewall 16, those sound signals will be absorbed by the sound absorbing layer 20 before they can reach the smart speaker device within the housing 2, Accordingly, when the doors 6 are closed, any sound or voice signals or random noise is prevented from entering the housing and cannot activate the smart speaker device therein, so that the smart speaker device can only be activated when the doors are intentionally opened.

Preferably, the sidewall 16 of the housing is formed from ABS plastic textured on the outside; the sound reflecting layer 18 is formed from chrome plating for reflecting sound, some of which will be diffused by outer textured surface of the sidewall; and the sound absorbing layer 20 is formed from CFAB cellulose acoustical material. It is, however, within the scope of the present invention to use any other appropriate materials for housing, the sound reflecting layer, and the sound absorbing layer.

Although it is preferable that the sound reflecting material be on the outside of the sidewall 16 and the sound absorbing layer be on the inside of the sidewall 16, it is within the scope of the present invention to provide the sound reflecting layer on the inside of the sidewall and the sound absorbing layer on the outside of the sidewall. In this manner, the outer sound absorbing layer will absorb incoming sound signals, and the inner layer of sound reflecting material will reflect any sound waves which have penetrated the layer of sound absorbing material and reflect those sound waves in any outward direction back towards the outer sound absorbing layer of material.

It is also within the scope of the present invention to provide only a layer of a sound reflecting material to only the outside or inside of the sidewall, or to provide only a layer of sound absorbing material to only the inside or outside of the sidewall.

As also illustrated by FIG. 5, the base 10 of the housing 2 defines an internal space or compartment designated by reference numeral 22. This compartment may be used for several different functions. It can be used to hold activation means for remotely opening and closing the doors 6 by an externally generated signal. The compartment may also house a device for generating audible signals to muffle external voice signals when the doors are closed.

Other modifications and advantages of the acoustic isolator device disclosed herein falling within the scope of the present invention will become apparent to persons skilled in the relevant art. For example, the arrangement of the doors to open and close the housing can be different from that illustrated in the drawings, and only a single and not multiple doors can be provided. Moreover, although it is preferred that the housing be provided with an internal electrical receptacle for powering the smart speaker device by an external source of electrical energy, the device can also be operated by electrical battery power alone, thereby eliminating the need to provide the internal electrical receptacle within the housing. Accordingly, the acoustic isolator devices in accordance with the preferred embodiments of the invention disclosed and illustrated herein are intended to be illustrative only, and not restrictive of the scope of the invention, that scope being defined by the following claims and all equivalents thereto.

The invention claimed is:

1. A housing for a sound activated smart speaker device, said housing comprising a sidewall and at least one closure element selectively operable and closable to provide access to within said housing, and a layer of sound reflecting material applied to one surface of the sidewall and to one surface of the closure element, and a layer of sound absorbing material applied to an opposite surface of said sidewall and to an opposite surface of said closure element, wherein a sound activated device within said housing cannot be activated when said closure element is in a closed position.

2. The housing as claimed in claim 1, wherein said sound reflecting material is applied to an outer surface of said sidewall and to an outer surface of said closure element.

3. The housing as claimed in claim 1, wherein said sound reflecting material is applied to an inner surface of said sidewall and to an inner surface of said closure element.

4. The housing as claimed in claim 1, wherein said sound absorbing material is applied to an inner surface of said sidewall and to an inner surface of said closure element.

5. The housing as claimed in claim 1, wherein said sound absorbing material is applied to an outer surface of said sidewall and to an outer surface of said closure element.

6. The housing as claimed in claim 1, wherein said sidewall and said closure element are formed from ABS textured plastic.

7. The housing as claimed in claim 1, wherein said sound reflecting material is formed from chrome plating.

8. The housing as claimed in claim 1, wherein said sound absorbing material is formed from CFAB cellulose acoustical material.

9. The housing as claimed in claim 1, further including a device for generating an audible signal to muffle external voice signals.

10. A housing for a sound activated smart speaker device, said housing comprising a sidewall and at least one closure element selectively operable and closable to provide access to within said housing, and a layer of sound reflecting material applied to one surface of the sidewall and to one surface of the closure element, and a layer of sound absorbing material applied to an opposite surface of said sidewall and to an opposite surface of said closure element, wherein a sound activated device within said housing cannot be activated when said closure element is in a closed position; and a stand for said housing, said stand having a layer of sound reflecting material applied to one surface thereof and a layer of sound absorbing material applied to an opposite surface thereof.

11. The housing as claimed in claim 10, Wherein said stand is hollow and defines an internal compartment therein.

12. A method for acoustically isolating a sound actuated smart speaker device from externally generated voice signals, said method comprising the steps of:

placing said smart speaker device in a housing having at least one selectively openable and closable closure element;

lining a sidewall of said housing with at least a layer of sound reflecting material on one surface thereof and a layer of sound absorbing material on an opposite surface thereof, and lining a sidewall of said closure element housing with at least a layer of sound reflecting material on one surface thereof and a layer of sound absorbing material on an opposite surface thereof.

13. The method of claim 12, comprising the step of lining an outer surface of said sidewall and an outer surface of said closure element with said sound reflecting material, and lining an inner surface of said sidewall and an inner surface of said closure element with said sound absorbing material.

14. The method of claim 12, comprising the step of lining an outer surface of said sidewall and an outer surface of said closure element with said sound absorbing material, and lining an inner surface of said sidewall and an inner surface of said closure element with said sound reflecting material.

15. The method of claim 12, comprising the step of placing a device for generating an audible signal within the housing for muzzling external voice signals.

* * * * *